US006578230B2

(12) United States Patent
Park et al.

(10) Patent No.: US 6,578,230 B2
(45) Date of Patent: Jun. 17, 2003

(54) UPRIGHT-TYPE VACUUM CLEANER HAVING A CYCLONE DUST COLLECTING APPARATUS

(75) Inventors: Kyu-Chang Park, Kwangju (KR); Jang-Keun Oh, Kwangju (KR)

(73) Assignee: Samsung Kwangju Electronics Co., Ltd., Kwangju (KR)

( * ) Notice: Subject to any disclaimer, the term of this patent is extended or adjusted under 35 U.S.C. 154(b) by 75 days.

(21) Appl. No.: 09/776,088

(22) Filed: Feb. 2, 2001

(65) Prior Publication Data

US 2001/0052166 A1 Dec. 20, 2001

(30) Foreign Application Priority Data

Jun. 16, 2000 (KR) ..... 2000-33337
Jun. 16, 2000 (KR) ..... 2000-33338

(51) Int. Cl.[7] ..... A47L 9/16

(52) U.S. Cl. ..... 15/353; 15/346; 15/352; 55/429; 55/459.1; 55/DIG. 3

(58) Field of Search ..... 15/353, 352, 346; 55/424, 459.1, DIG. 3

(56) References Cited

U.S. PATENT DOCUMENTS 4,853,008 A * 8/1989 Dyson ..... 15/353
5,078,761 A * 1/1992 Dyson ..... 55/337
5,090,976 A * 2/1992 Dyson ..... 55/337
5,145,499 A * 9/1992 Dyson ..... 15/352
5,779,745 A 7/1998 Kilström
5,935,279 A 8/1999 Kilström ..... 55/337
6,312,594 B1 * 11/2001 Conrad et al. ..... 210/512.1

FOREIGN PATENT DOCUMENTS

| | | |
|---|---|---|
| DE | 9945403 | 6/2000 |
| DE | 0110581 | 11/2001 |
| EP | 0042 723 | 6/1981 |
| EP | 0489565 | 6/1995 |
| EP | 0928 594 A1 | 3/1998 |
| GB | 2 321 181 A | 7/1998 |
| WO | WO 95/16382 | 6/1995 |
| WO | WO 0004816 | 2/2000 |
| WO | WO 0135809 | 5/2001 |

* cited by examiner

*Primary Examiner*—Theresa T. Snider
(74) *Attorney, Agent, or Firm*—Ladas & Parry

(57) ABSTRACT

An upright-type vacuum cleaner includes a cleaner body having a dust collecting chamber and a motor driving chamber, a suction brush, and a cyclone dust collecting device removably mounted on the dust collecting chamber. The cyclone dust collecting device includes a cover, first and second cyclone bodies for centrifuging and collecting contaminants entrained in the air, a lower door, and an outlet pipe. The second cyclone body includes a grill having a plurality of perforations formed therein to filter out small particle contaminants. The lower door is removably mounted on a lower end of the first cyclone body, and the outlet pipe discharges the clean air. The cyclone dust collecting device prevents a backflow of contaminants, thereby, collecting contaminants are more effectively.

5 Claims, 5 Drawing Sheets

UPRIGHT-TYPE VACUUM CLEANER HAVING A CYCLONE DUST COLLECTING APPARATUS

BACKGROUND OF THE INVENTION

1. Field of the Invention

The present invention relates to an upright-type vacuum cleaner, and more particularly, to an upright-type vacuum cleaner having a cyclone dust collecting apparatus for separating and collecting contaminants that are entrained in the air that is sucked through a suction brush of the vacuum cleaner.

2. Description of the Related Art

Generally, an upright-type vacuum cleaner has a suction brush that is movably connected to a cleaner body. The suction brush moves along the cleaning surface during the cleaning process. The cleaner body has a dust collecting chamber and a motor driving chamber. A dust filter is removably disposed in the dust collecting chamber, and a motor is disposed in the motor driving chamber.

When the motor operates, it generates a strong suction force at the suction brush. The suction force draws contaminants entrained in air on the cleaning surface through the suction brush and into the cleaner body. The air is then discharged through a dust filter disposed in the dust collecting chamber of the cleaner body. The contaminants entrained in the air are collected by the dust filter, and the clean air is discharged into the outside atmosphere through the motor driving chamber.

A conventional upright-type vacuum cleaner collects contaminants by using an expandable dust filter. When the dust filter is full of contaminants, the dust filter must be replaced manually. Manual replacement of the dust filter is inconvenient and unsanitary.

SUMMARY OF THE INVENTION

The present invention has been made to overcome the above-mentioned problems of the related art. It is an object of the present invention to provide an upright-type vacuum cleaner having a cyclone dust collecting apparatus for collecting contaminants entrained in the air that is drawn in through a suction brush.

The above object is accomplished by an upright-type vacuum cleaner in accordance with the present invention, which includes: a cleaner body having a dust collecting chamber and a motor driving chamber; a suction brush connected to the cleaner body; and a cyclone dust collecting device removably mounted in the dust collecting chamber. The dust collecting chamber has a first inlet port and a first outlet port, and the motor driving chamber is connected to the first outlet port. The cyclone dust collecting device includes: a cover; a first cyclone body joined with the cover and having a second inlet port corresponding to the first inlet port for centrifuging and collecting contaminants entrained in the air that is drawn in through the second inlet port; a second cyclone body also coupled to the cover and disposed inside of the first cyclone body; a lower door; and an outlet pipe. The second cyclone body includes a grill having a plurality of perforations and has a third inlet port for inducing the air from the grill into a vortex. The lower door is removably mounted on a lower end of the first cyclone body and has a second outlet port that corresponds to the first outlet port. Finally, the outlet pipe, which is connected to the second outlet port, collecting and discharges the air from the second cyclone body.

The above object can also be accomplished by an upright-type vacuum cleaner in accordance with another embodiment of the present invention, which includes: a cleaner body having a dust collecting chamber, which has a first inlet port and a first outlet port, and a motor driving chamber connected to the first outlet port; a suction brush connected to the cleaner body; and a cyclone dust collecting device removably mounted in the dust collecting chamber for separating by centrifugal force and collecting contaminants entrained in the air which is drawn in through the suction brush. The cyclone dust collecting device includes: a cyclone body having a second inlet port corresponding to the first inlet port; and a second outlet port corresponding to the first outlet port, for inducing the air which is drawn in through the second inlet port, together with contaminants, into a vortex; and a dust collecting receptacle removably disposed in the cyclone body for centrifuging and collecting contaminants entrained in the vortex of air.

BRIEF DESCRIPTION OF THE DRAWINGS

The above object and other features and advantages of the present invention will become readily apparent by reference to the following detailed description when considered in conjunction with the accompanying drawings, in which.

DETAILED DESCRIPTION OF THE PREFERRED EMBODIMENTS

Hereinafter, the preferred embodiments of the present invention will be described in further detail with reference to the accompanying drawings.

Figure 1:
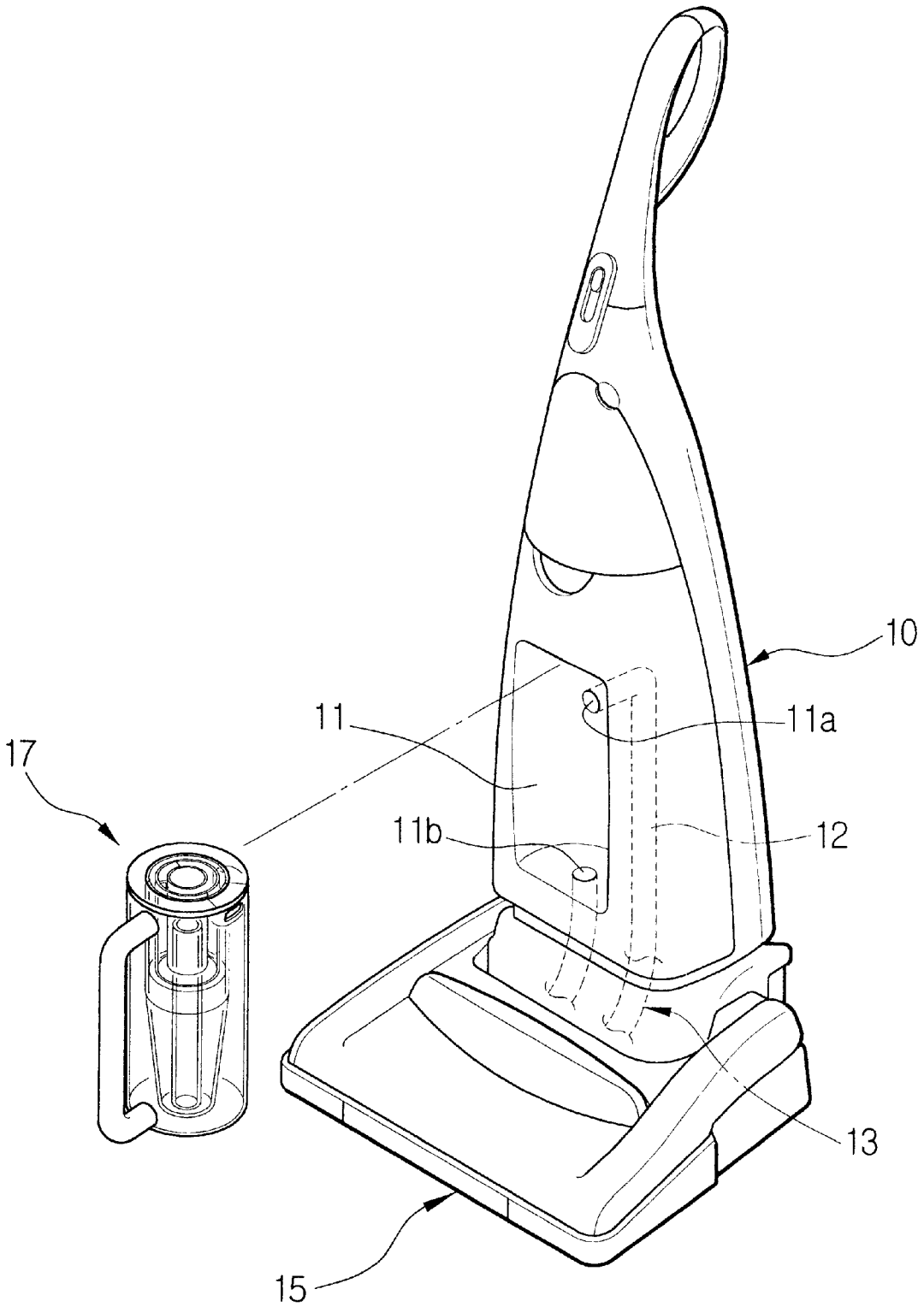
FIG. 1 is a perspective view showing an upright-type vacuum cleaner having a cyclone dust collecting device in accordance with a first preferred embodiment of the present invention.
Figure 2:
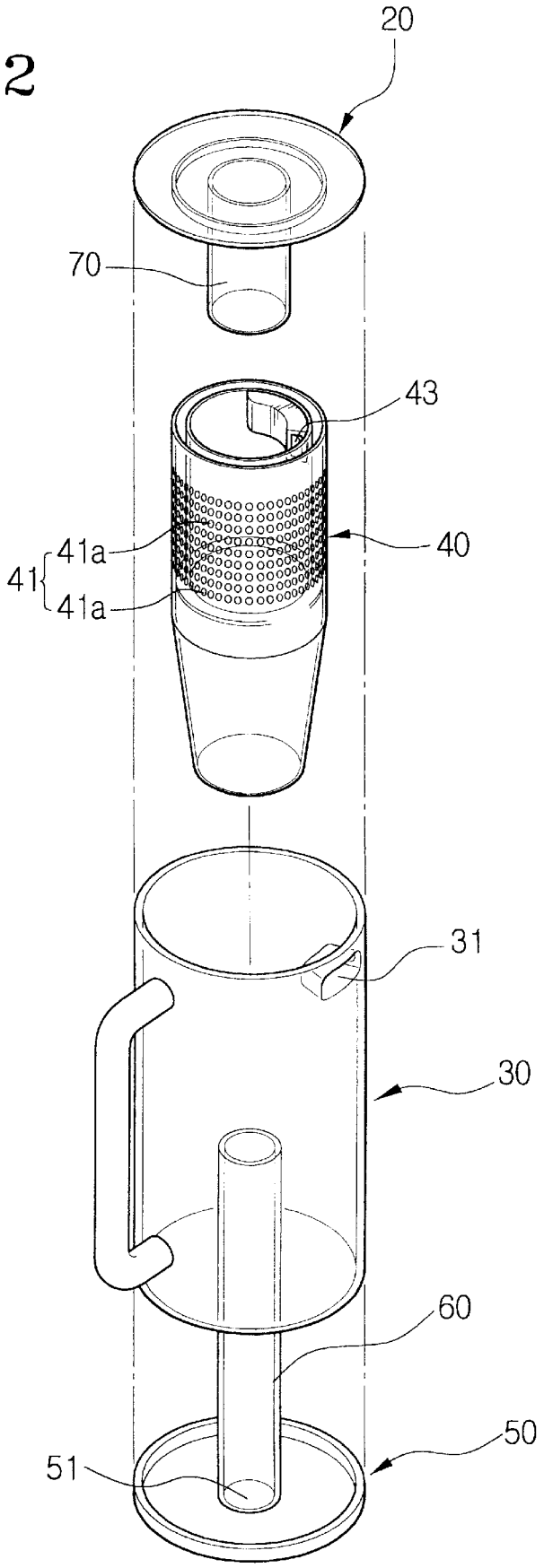
FIG. 2 is an exploded perspective view showing the cyclone dust collecting device of FIG. 1.
Figure 3:
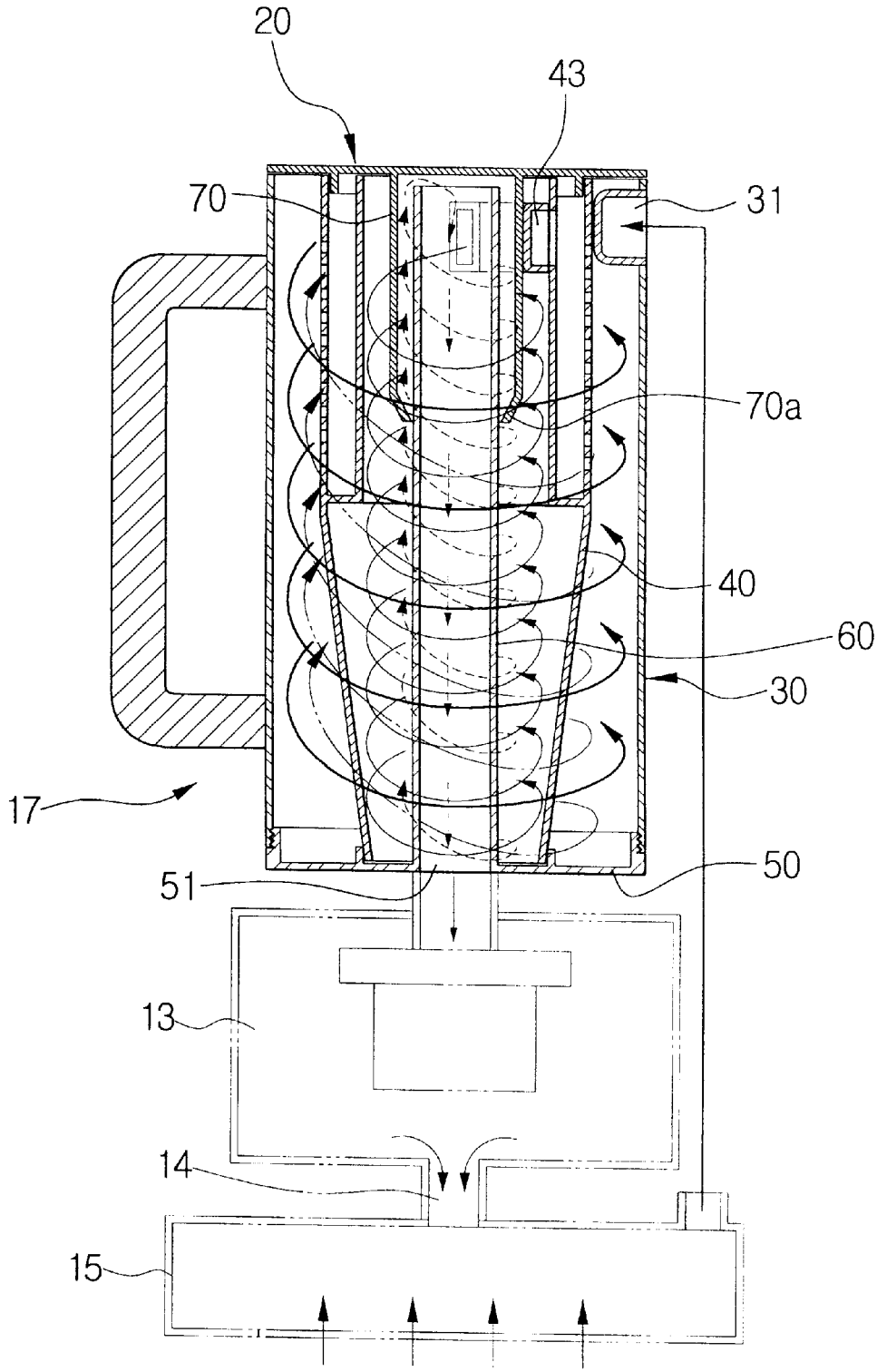
FIG. 3 is a sectional view of the cyclone dust collecting device of FIG. 2 in an assembled state.

An upright-type vacuum cleaner having a cyclone dust collecting apparatus according to a first preferred embodiment of the present invention is shown in FIGS. 1, 2 and 3. Referring first to FIG. 1, the upright-type vacuum cleaner includes, a cleaner body 10 having a dust collecting chamber 11 and a motor driving chamber 13, a suction brush 15 pivotally connected to the cleaner body 10, and a cyclone dust collecting device 17.

A first inlet port 11*a* is formed at one end of a suction pipe 12 which connects the suction brush 15 with the cyclone dust collecting device 17. A first outlet port 11*b* connected to the motor driving chamber 13 is formed in the dust collecting chamber 11. Preferably, the first inlet port 11*a* is formed in an upper portion of the dust collecting chamber 11, and the first outlet port 11*b* is formed in the bottom of the dust collecting chamber 11.

The cyclone dust collecting device 17, which is detachably mounted on the dust collecting chamber 11, separates, using centrifugal force, contaminants from the air that is drawn in through the suction brush 15 and the suction pipe 12, and collects the contaminants.

As shown in FIGS. 2 and 3, the cyclone dust collecting device 17 includes a circular cover 20, a first cyclone body 30, a second cyclone body 40, a lower door 50, and an outlet pipe 60.

The first cyclone body 30 is substantially cylindrical and has open upper and lower ends. The upper end of the first cyclone body 30 is joined with the cover 20, and the lower end of the first cyclone body 30 is joined with the lower door 50. A second inlet port 31 corresponding to the first inlet port 11*a* is formed in the first cyclone body 30. The first cyclone body 30, in cooperation with the cover 20, induces the air that is sucked through the second inlet port 31 into a vortex and collects the contaminants of relatively large particles that are entrained in the air.

The second cyclone body 40 is also substantially cylindrical and has open upper and lower ends. The second cyclone body 40 is joined with the cover 20 and fits inside of the first cyclone body 30. The second cyclone body 40 includes a grill 41 with a plurality of perforations 41*a* formed therein. The perforations 41*a* enable air ascending in a reverse direction from the bottom of the first cyclone body 30 to flow through and into the second cyclone body 40. The second cyclone body 40 further includes a third inlet port 43 for inducing the air which passes through the grill 41 into a vortex. In this manner, additional contaminants entrained in the air are collected by the vortex-induced flow from the third inlet port channel 43.

The lower door 50 is removably mounted on the lower end of the first cyclone body 30 and receives contaminants that have been collected in the first and second cyclone bodies 30 and 40, respectively. The lower door 50 is preferably joined to the lower end of the first cyclone body 30 with a screw. In the center of the lower door 50, a second outlet port 51 is formed. The second outlet port 51 corresponds to the first outlet port 11*b*.

An outlet pipe 60 is mounted on the lower door 50 and connected to the second outlet port 51. The outlet pipe 60 stands upright inside of the second cyclone body 40, and the top of outlet pipe 60 is spaced apart from the cover 20 by a predetermined distance. The spacing between the top of outlet pipe 60 and the cover 20 enables the air, which has ascended in a reverse direction from the bottom of the second cyclone body 40 to the top to be discharged through the second outlet port 51.

In addition, the cyclone dust collecting device 17 preferably includes an air collector 70. The air collector 70 is joined with the cover 20 and disposed between the outlet pipe 60 and the second cyclone body 40. The air collector 70 induces the air that is sucked into the second cyclone body 40 through the third inlet port 43 into a vortex, and exclusively guides the reverse-ascending air flow into the outlet pipe 60. The air collector 70 prevents the air that is drawn into the third inlet port 43 from flowing directly into the outlet pipe 60. Thus, the air collector 70 helps to centrifuge fine contaminants entrained in the air. The air collector 70 includes a skirt section 70*a* (FIG. 3) that gradually decreases in diameter as it extends down toward the lower door 50. The skirt section 70*a* prevents fine contaminants from entering the space between the air collector 70*b* and the outlet pipe 60 and escaping out the outlet pipe 60.

As shown in FIG. 3, preferably, an air circulation path 14 is formed for connecting the motor driving chamber 13 and the suction brush 15. The air is discharged from the second outlet port 51 into the motor driving chamber 13, and then passed though the air circulation path 14 into the suction brush 15. The air discharged though the suction brush 15 is then drawn in through the first inlet port 11*a* of FIG. 1 along with contaminants on the cleaning surface. Since the air is continuously circulated, instead of being released to the outside atmosphere, it is not necessary to provide a vent in the cleaner body 10. In addition, the cleaning efficiency of the vacuum cleaner is enhanced due to continuous circulation resulting, in repeated collection of fine contaminants which were not collected by centrifugation during the cleaning process.

The operation of the upright-type vacuum cleaner with the cyclone dust collecting device 15 will now be described with reference to FIG. 3.

When power is supplied to the upright-type vacuum cleaner having the cyclone dust collecting device 17 in the dust collecting chamber 11, the motor, which is located in the motor driving chamber 13, operates to generate a suction force. The suction force draws air and contaminants that are entrained therein into the suction brush 15, the suction pipe 12, the first inlet port 11*a*, and the second inlet port 31 in due order. The air, together with the contaminants, is induced into a vortex by the first cyclone body 30, acting in cooperation with the cover 20, and descends toward the lower door 50. In this process, the relatively large particle contaminants are separated from the vortex of air by centrifugal force and collected in the lower door 50.

When the vortex of air reaches the bottom of the first cyclone body 30, the air ascends in a reverse direction. The reverse-ascending air passes through the grill 41 and into the third inlet port 43. The air that is drawn into the third inlet port 43 is once again induced into a diagonal vortex in the second cyclone body 40. Accordingly, in the second cyclone body 40, the fine contaminants entrained in the air are separated from the air by centrifugal force and fall to the bottom. The descending vortex of air in the second cyclone body 40 once again ascends in a reverse direction when it reaches the bottom. The vortex of air ascends along the air collector 70 toward the upper portion of the second cyclone body 40, and begins to descend again when it reaches the cover 20. The descending air is then sucked through the outlet pipe 60 and discharged through the second outlet port 51, the air circulation path 14, and the motor driving chamber 13 in due order. Instead of being dispersed to the outside atmosphere, the discharged air from the motor driving chamber 13 is drawn back into the cyclone dust collecting device 17, along with additional contaminants on the cleaning surface, to repeat the process described above.

A second preferred embodiment of a cyclone dust collecting apparatus for an upright-type vacuum cleaner will now be described with reference to FIGS. 4 and 5.

Figure 4:
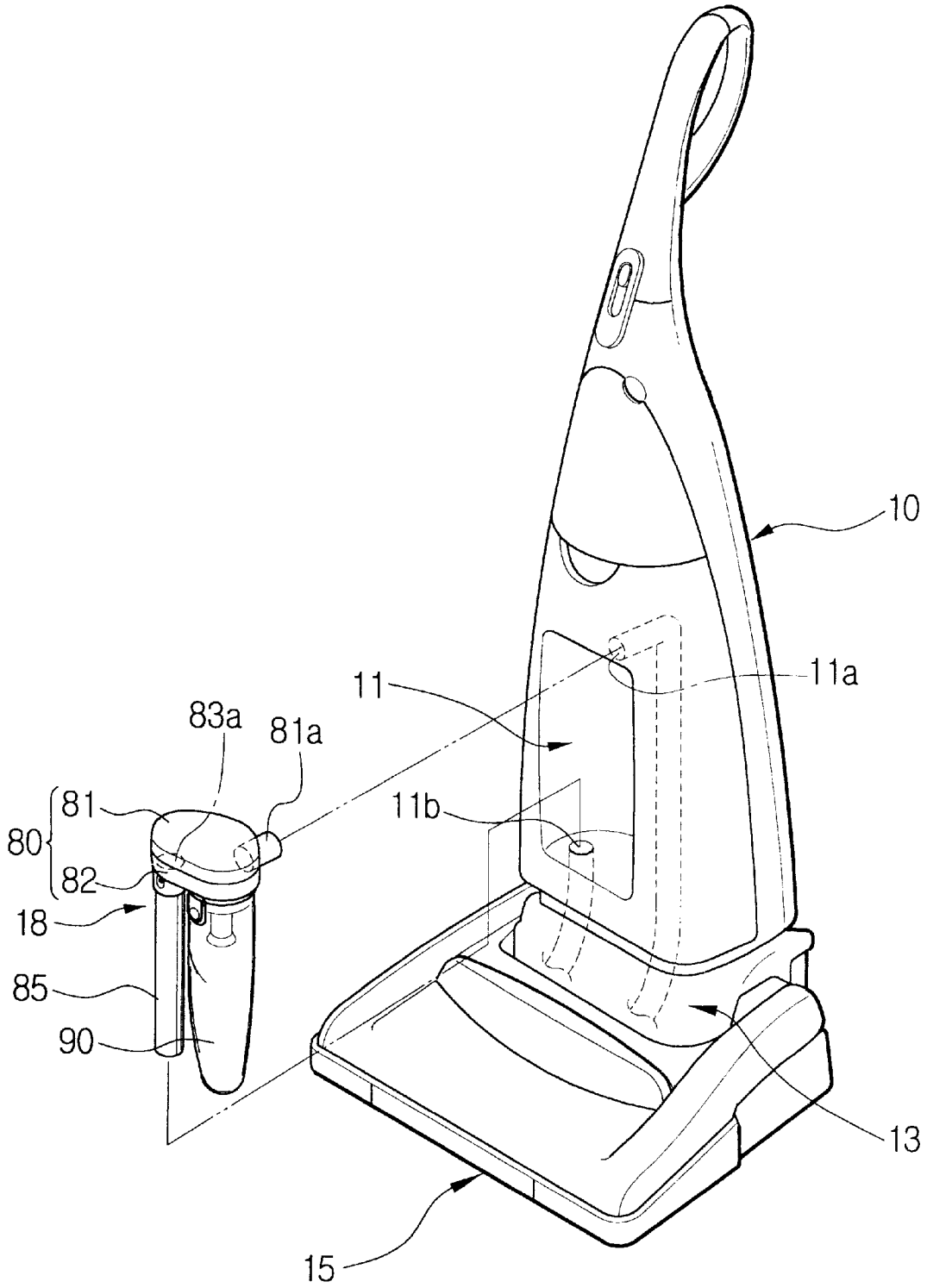
FIG. 4 is a perspective view showing an upright-type vacuum cleaner having a cyclone dust collecting device in accordance with a second preferred embodiment of the present invention.

Referring to FIG. 4, the upright-type vacuum cleaner includes a cleaner body 10 having a dust collecting chamber 11 and a motor driving chamber 13, a suction brush 15 pivotally connected to the cleaner body 10, and a cyclone dust collecting device 18 for centrifuging and collecting contaminants entrained in the air that is drawn in through the suction brush 15.

The dust collecting chamber 11 includes a first inlet port 11*a* formed at one end of a suction pipe, which is connected to the suction brush 15, and a first outlet port 11*b* connected to the motor driving chamber 13. Preferably, the first inlet port 11*a* is formed in an upper portion of the dust collecting chamber 11, and the first outlet port 11*b* is formed in the bottom of the dust collecting chamber 11.

The cyclone dust collecting device 18 separates, using centrifugal force, contaminants from the air that is drawn in through the suction brush and collects the contaminants. The cyclone dust collecting device 18 includes a cyclone body 80 and a dust collecting receptacle 90 that is removably coupled to the cyclone body 80.

Figure 5:
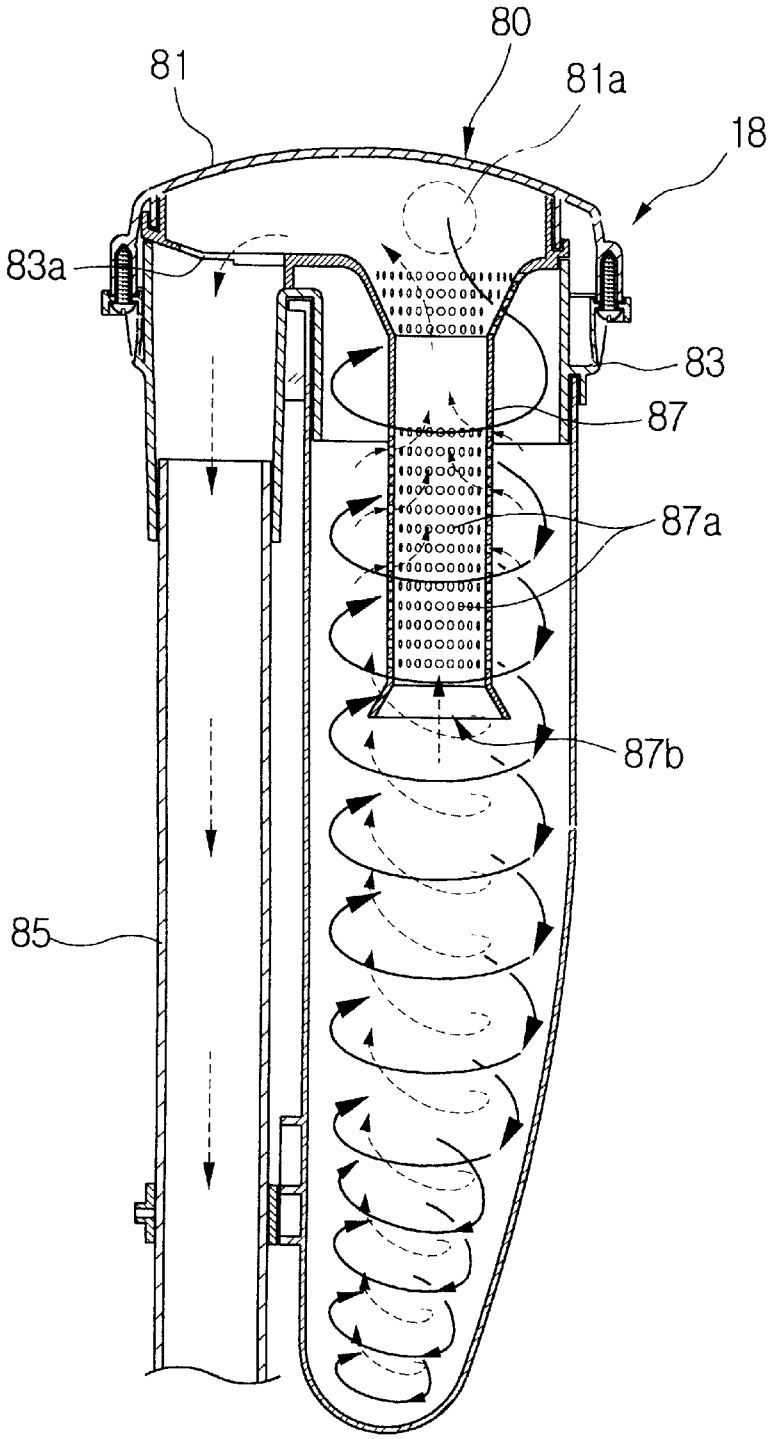
FIG. 5 is a sectional view of the cyclone dust collecting device of FIG. 4.

As shown in FIG. 5, the cyclone body 80 consists of an upper body 81 and a lower body 83 joined together with a screw. A second inlet port 81*a* corresponding to the first inlet port 11*a* is formed in the upper body 81. A second outlet port 83*a* corresponding to the first outlet port 11*b* is formed in the lower body 83. The cyclone body 80 as constructed above induces the air that is sucked through the second inlet port 81*a* into a vortex. The dust collecting receptacle 90 collects the contaminants that have been separated from the vortex of air by centrifugal force.

The lower body 83 of the cyclone body 80 has an outlet pipe 85 which connects the second outlet port 83*a* with the first outlet port 11*b*.

A grill 87 is formed in the dust collecting receptacle 90. The grill 87 is substantially cylindrical and extends in a predetermined length toward the lower portion of the dust collecting receptacle 90. The grill 87 prevents any backflow of contaminants when the air is discharged through the second outlet port 83*a*. The upper portion of the grill 87 is formed between the upper body 81 and the lower body 83 in a shape as shown in FIG. 5 to prevent the second inlet port 81*a* from communicating directly with the second outlet port 83*a*.

The operation of the upright-type vacuum cleaner according to the second preferred embodiment of the present invention as constructed above will now be described with reference to FIG. 5.

When power is applied to the vacuum cleaner, the motor in the motor driving chamber 13 operates to generate a suction force. The suction force draws air and contaminants that are entrained therein into the suction brush 15, the first inlet port 11*a*, the second inlet port 81*a*, and the cyclone body 80 in due order. The drawn in air is induced into a vortex by the cyclone body 80 in cooperation with the dust collecting receptacle 90, and descends toward the bottom of the dust collecting receptacle 90. In this process, the relatively large particle contaminants are separated from the vortex of air by centrifugal force and collected in the dust collecting receptacle 90.

At the bottom of the dust collecting receptacle 90, the vortex of air reverses direction and ascends. The reverse-ascending air is drawn into the second outlet port 83*a* through both the perforations 87*a* in the grill 87 and a lower opening 87*b* in the grill 87. Here, in the center of the dust collecting receptacle 90, the lighter air flows through the lower opening 87*b* of the grill 87, and the heavier air, which contains contaminants, ascends in the reverse direction along the inner circumference of the dust collecting receptacle 90. The contaminants entrained in the heavier, reverse-ascending air along the inner circumference of the dust collecting receptacle 90, are filtered out when the air passes through the perforations 87*a* in the grill 87, and the contaminants descend toward the bottom of the dust collecting receptacle 90. Accordingly, The grill 87 prevents a backflow of the contaminants, and only the light and cleaner air is discharged through the second outlet port 83*a*.

The discharged air from the second outlet port 83*a* flows into the outlet pipe 85, the motor driving chamber 13, the suction brush 15 in due order. Instead of being released to the outside atmosphere, the air is drawn back into the cyclone dust collecting device 17 through the first inlet port 11*a* and the second inlet port 81*a*, together with additional contaminants on the cleaning surface.

The contaminants collected in the dust collecting receptacle 90 can be removed by separating the dust collecting receptacle 90 from the cyclone body 80 and disposing of the contaminants.

As described above, the upright-type vacuum cleaner according to the present invention effectively collects contaminants by preventing a backflow of the contaminants that are collected in the dust collecting device.

Furthermore, since the discharged air is continuously circulated instead of being dispersed into the outside atmosphere, it simplifies the appearance of the cleaner body, as there is no need for a vent. In addition, the present invention enhances the efficiency with which contaminants are collected and improves sanitation conditions, by preventing dust from being dispersed with the discharged air.

What is claimed is:

1. An upright-type vacuum cleaner comprising:

a cleaner body including a dust collecting chamber and a motor driving chamber, the dust collecting chamber having a first inlet port and a first outlet port, the motor driving chamber being connected to the first outlet port;

a suction brush movably connected to the cleaner body; and a cyclone dust collecting means removably mounted in the dust collecting chamber for centrifuging and collecting contaminants entrained in air that is drawn in through the suction brush into the first inlet port, the cyclone dust collecting means including:

a cover;

a first cyclone body coupled to the cover, the first cyclone body having a second inlet port communicating with the first inlet port for inducing the air and contaminants into a vortex and collecting contaminants of relatively large particles by centrifugation;

a second cyclone body coupled to the cover and disposed inside of the first cyclone body, the second cyclone body including a grill having a plurality of perforations through which reverse-ascending air from a bottom of the first cyclone body flows, and a third inlet port for inducing the air from the grill into a vortex;

a lower door removably mounted on a lower end of the first cyclone body, the lower door having a second outlet port communicating with the first outlet port; and an outlet pipe connected to the second outlet port for discharging the air from the second cyclone body to the motor driving chamber.

2. The upright-type vacuum cleaner as claimed in claim 1, further comprising an air collector coupled to the cover and disposed between the outlet pipe and the second cyclone body, the air collector preventing the air drawn in through the third inlet port from flowing directly into the outlet pipe.

3. The upright-type vacuum cleaner as claimed in claim 2, wherein the air collector further comprises a skirt section having a gradually decreasing diameter toward the lower door.

4. The upright-type vacuum cleaner as claimed in any one of claims 1 to 3, further comprising an air recirculation path connecting the motor driving chamber with the suction brush, the air recirculation path circulating the air discharged into the motor driving chamber into the suction brush and the first air inlet port.

5. The upright-type vacuum cleaner as claimed in any one of claims 1 to 3, wherein the first inlet port is formed in an upper portion of the dust collecting chamber, and the first outlet port is formed in a bottom portion of the dust collecting chamber.

* * * * *